US007559772B2

(12) United States Patent
Tsai

(10) Patent No.: US 7,559,772 B2
(45) Date of Patent: Jul. 14, 2009

(54) MULTI-CONDUCTOR FLAT CABLE CONNECTOR

(75) Inventor: Wang-Kun Tsai, Taoyuan (TW)

(73) Assignee: P-Two Industries Inc., Taoyuan (TW)

( * ) Notice: Subject to any disclaimer, the term of this patent is extended or adjusted under 35 U.S.C. 154(b) by 0 days.

(21) Appl. No.: 11/812,829

(22) Filed: Jun. 22, 2007

(65) Prior Publication Data

US 2007/0298659 A1 Dec. 27, 2007

(30) Foreign Application Priority Data

Jun. 27, 2006 (TW) ..... 95123247 A

(51) Int. Cl.
*H01R 12/00* (2006.01)

(52) U.S. Cl. ..... 439/67; 439/495; 439/499

(58) Field of Classification Search ..... 439/67, 439/260, 267, 325, 329, 400, 492, 497, 495, 439/499, 607
See application file for complete search history.

(56) References Cited

U.S. PATENT DOCUMENTS 3,159,447 A * 12/1964 Crimmins et al. ..... 439/496
3,188,601 A * 6/1965 De Tar ..... 439/328
3,702,982 A * 11/1972 Kelly et al. ..... 439/418
4,802,866 A * 2/1989 Balzano et al. ..... 439/496
7,025,626 B2 * 4/2006 Fuerst et al. ..... 439/496

* cited by examiner

*Primary Examiner*—Briggitte R Hammond
*Assistant Examiner*—Vanessa Girardi
(74) *Attorney, Agent, or Firm*—Rosenberg, Klein & Lee

(57) ABSTRACT

An electrical connector is provided, which includes an insulative housing and a flexible bus inserted into the insulative housing. The insulative housing includes a base defining a slot therein, and a mating portion connected with the base. Mounting portions are integrally formed on opposite sides of the base for receiving fixing sheets. The flexible bus has a top surface and a bottom surface, the bottom surface forming a plurality of contact points on an end thereof. When the flexible bus extends into the slot of the insulative housing, contact points of the flexible bus are exposed out of a side of the mating portion for electrically connecting with a mating connector.

12 Claims, 7 Drawing Sheets

FIG. 3

MULTI-CONDUCTOR FLAT CABLE CONNECTOR

BACKGROUND OF THE INVENTION

1. Field of the Invention

The present invention relates to an electrical connector, and particularly to an electrical connector with shortened assembly labor time and reduced production cost.

2. Related Art

Mounted between Liquid Crystal Display (LCD) and a computer enclosure is a signal transmission interface, which is commonly a Low Voltage Differential System (LVDS) with super-high speed, low power-consumption and low electromagnetic radiation. Such an electrical connector is often of a male fashion.

Referring to FIGS. 1 and 2, a conventional male connector generally comprises an insulative housing 10 defining a plurality of passageways 11 in parallel therein. A plurality of conductive terminals 12 is received in the passageways 11. Mounting portions 13 are respectively formed on opposite sides of the insulative housing 10. Each mounting portion 13 has a positioning sheet 14 to lock with a mating connector (not shown) when the male connector is inserted into the mating connector. The conductive terminals 12 electrically connect with the mating connector.

During the conductive terminals 12 of the conventional male connector are assembled, each conductive terminal 12 is welded to an individual transmission wire 15. Then the conductive terminals 12, along with the transmission wires 15, are respectively inserted into the passageways 11. Finally the transmission wires 15 are twisted to a bundle and are enveloped by an insulative layer 16 (shown in FIG. 2) to be fixed together.

Assembly of the conductive terminals 12 is troublesome, for example, each conductive terminal 12 is required to be welded to a transmission wire 15, to be inserted and positioned, and to be twisted to a bundle and enveloped by an insulative layer 16 before being employed. Moreover, a male connector includes so many conductive terminals 12, which further increases assembly time and production cost. Additionally, a plurality of passageways 11 is formed in the insulative housing 10 in advance for receiving the conductive terminals 12. The passageways 11 are arrayed rather closely and are spaced small distance apart from each other. This increases a defective rate of the insulative housing 10, correspondingly increasing the overall cost.

SUMMARY OF THE INVENTION

An object of the present invention is to provide an electrical connector which reduces assembly time and production cost.

Another object of the present invention is to provide an electrical connector with simplified structure.

To achieve the above objects, the electrical connector according to the present invention comprises an insulative housing and a flexible bus inserted into the insulative housing. The insulative housing includes a base and a mating portion connected with each other. A slot is defined in the base. The flexible bus has a top surface and a bottom surface, the bottom surface forming a plurality of contact points on an end thereof. An end of the flexible bus extends through the slot of the insulative housing, and the contact points are exposed out of the mating portion.

DESCRIPTION OF THE PREFERRED EMBODIMENTS

Figure 1:
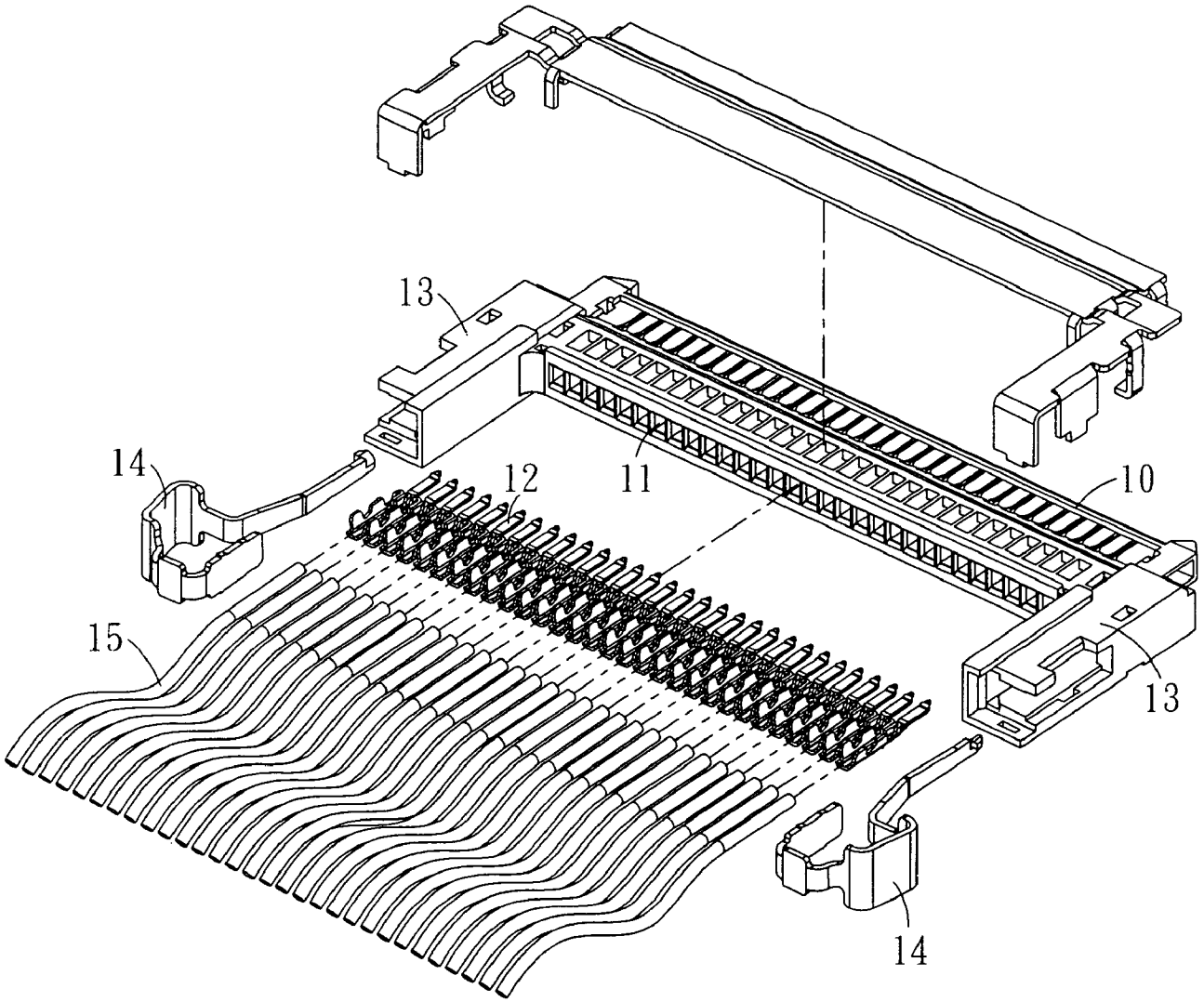
FIG. 1 (Prior Art)
FIG. 1 is an exploded view of an electrical connector according to a conventional male connector.
Figure 2:
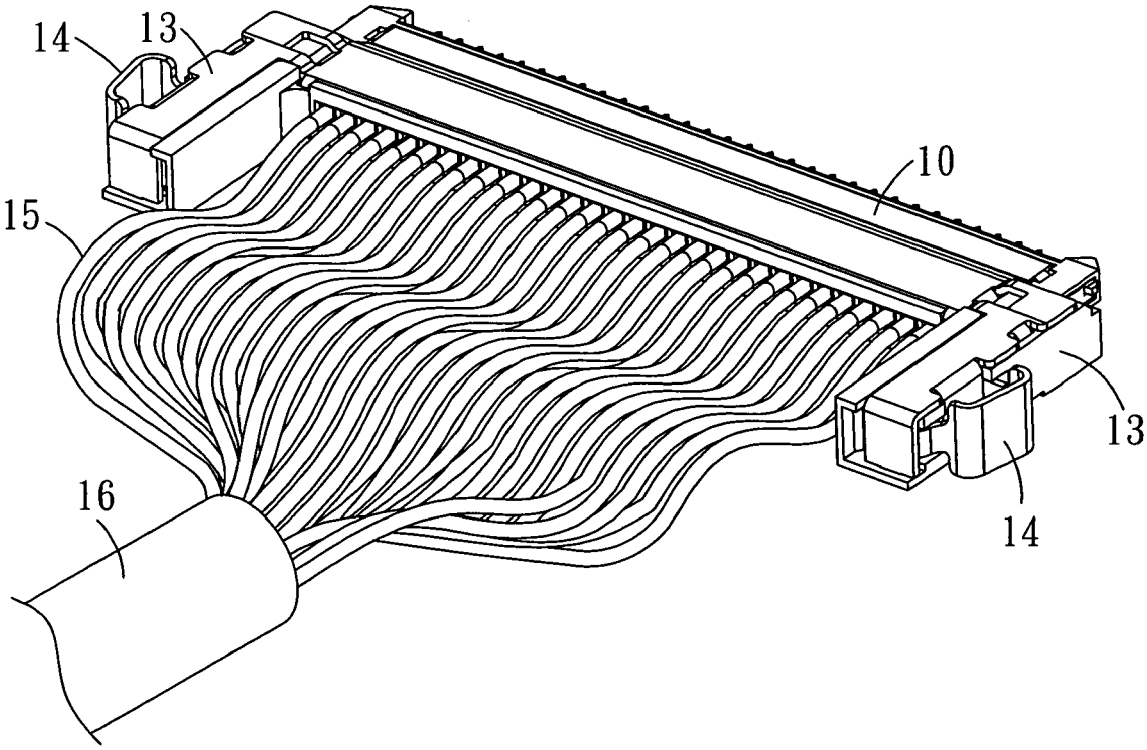
FIG. 2 (Prior Art)
FIG. 2 is a perspective view of the electrical connector of FIG. 1.
Figure 3:
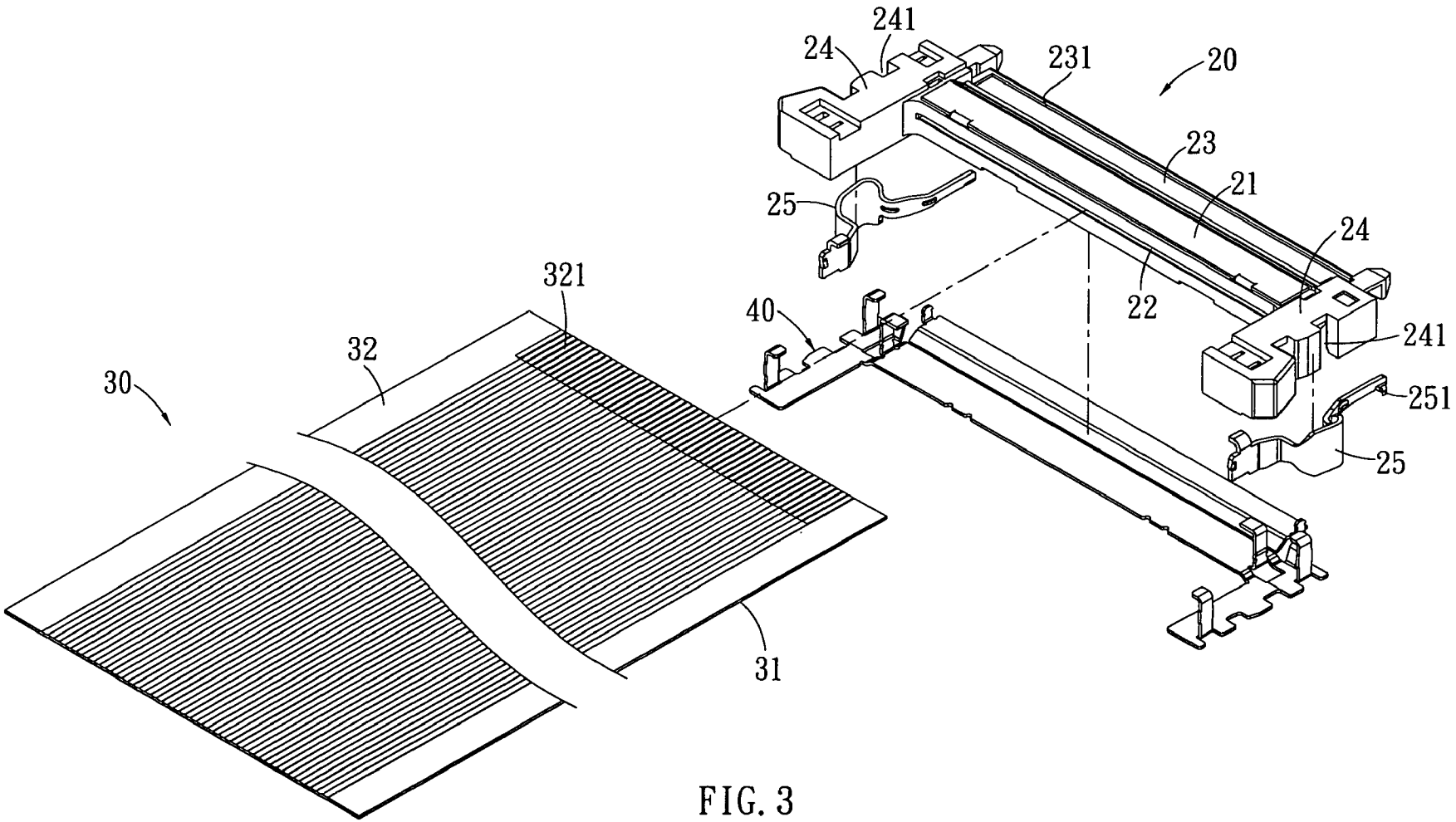
FIG. 3 is an exploded view of an electrical connector according to the present invention, wherein the electrical connector stands upside down.
Figure 4:
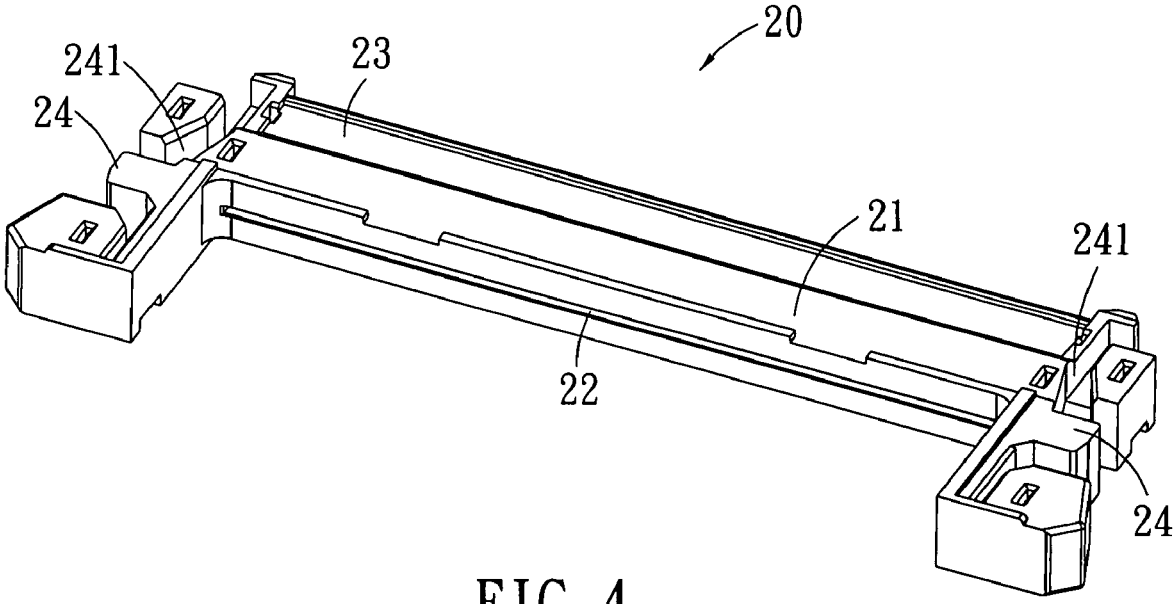
FIG. 4 is a perspective view of an insulative housing of the electrical connector of FIG. 3.
Figure 5:
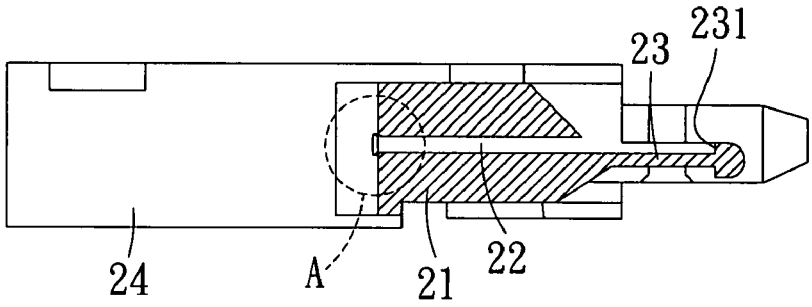
FIG. 5 is a cross-sectional view of the insulative housing of FIG. 4.

Referring to FIGS. 3, 4 and 5, an electrical connector in accordance with the present invention comprises an insulative housing 20 and a flexible bus 30 inserted into the insulative housing 20. In FIG. 3 through 8, the electrical connector stands upside down for being clearly shown.

The insulative housing 20 comprises a substantially rectangular base 21 and a mating portion 23 connected with the base 21. An elongated slot 22 is defined substantially in a middle of the base 21 and through the base 21. The mating portion 23 forms an abutting end 231 on a front thereof. Mounting portions 24 are integrally formed on opposite sides of the base 21. Each mounting portion 24 defines a groove 241 in a side thereof for receiving a fixing sheet 25. The fixing sheet 25 forms a tab 251 on a front thereof for locking with a mating connector (not shown). A shell 40 is provided to shield the insulative housing 20 thereof and prevents the fixing sheets 25 against disengaging from the mounting portions 24 of the insulative housing 20.

The flexible bus 30 includes a top surface 31 and a bottom surface 32. A plurality of contact points 321 is formed on a front end of the bottom surface 32.

Figure 6:
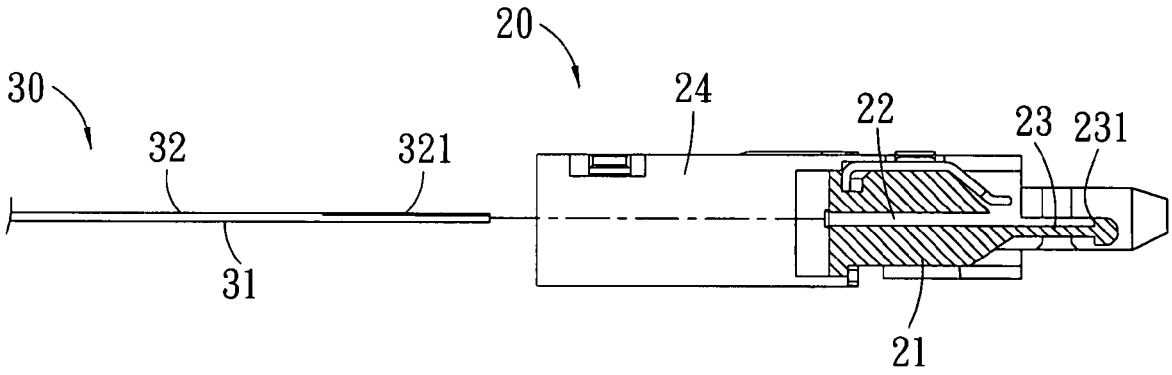
FIG. 6 is a side cross-sectional view of the electrical connector of FIG. 3, wherein a flexible bus is disassembled from the insulative housing thereof.
Figure 7:
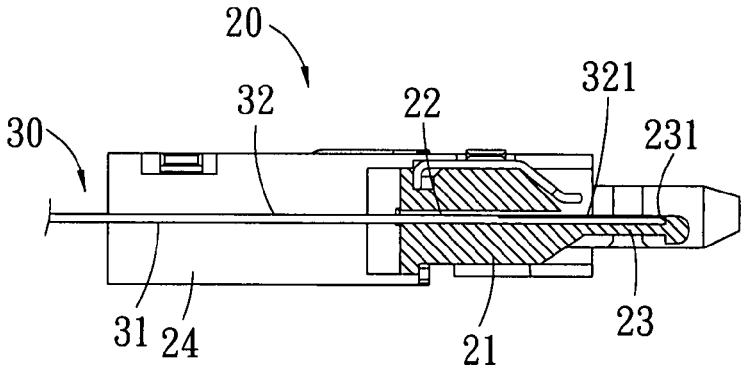
FIG. 7 is a side cross-sectional view of the electrical connector of FIG. 3, wherein the electrical connector is assembled completely.
Figure 8:
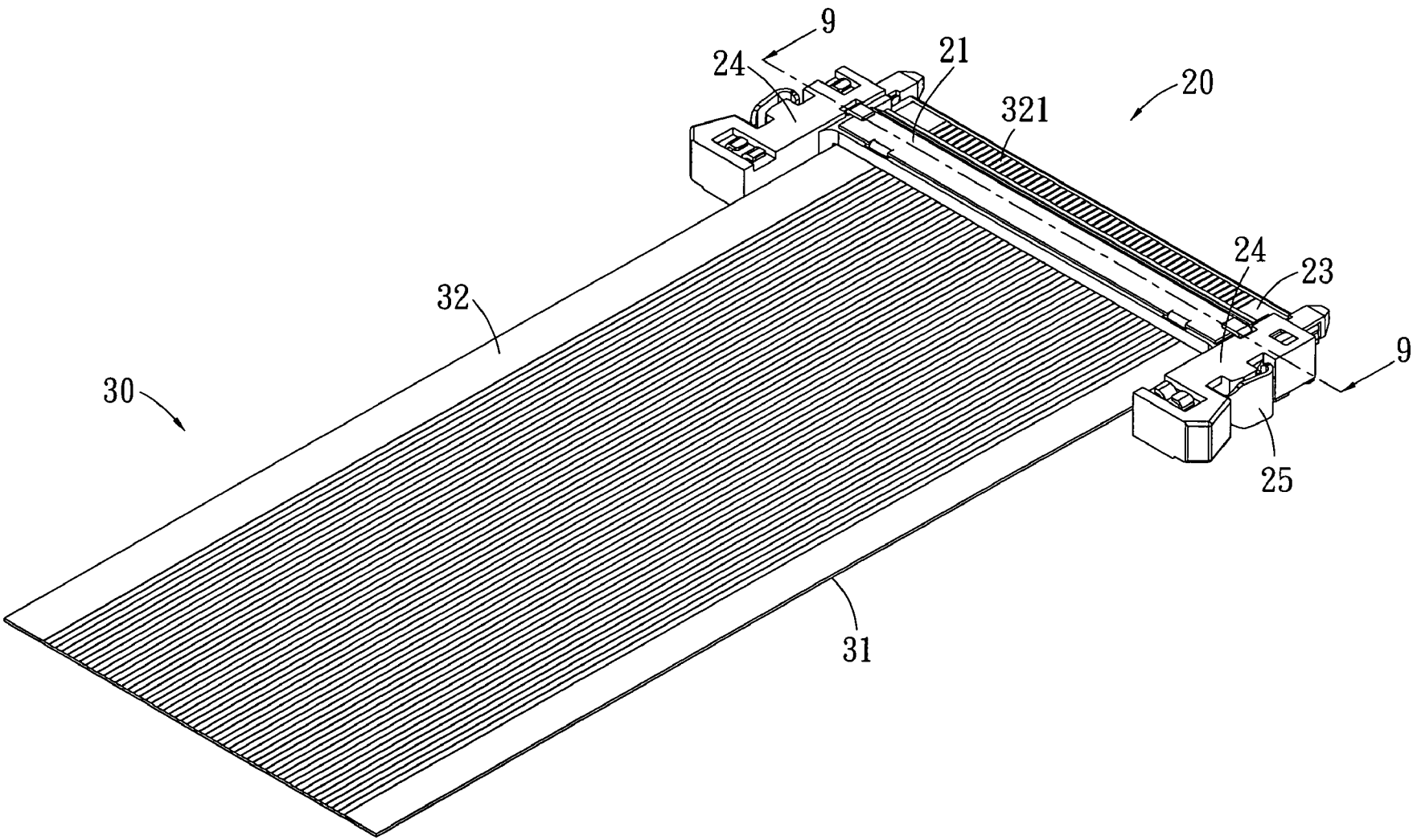
FIG. 8 is an assembled view of the electrical connector of FIG. 3.

Referring to FIGS. 6, 7 and 8, a front end of the top surface 31 of flexible bus 30 is coated with glues, and is extended from a front of the insulative housing 20 and through the slot 22 of the base 21 to be glued to the mating portion 23. Alternatively, the flexible bus 30 may be attached to the mating portion 23 by adhesive plaster or other ways. When the flexible bus 30 is positioned, the top surface 31 of the flexible bus 30 abuts against the mating portion 23, and the contact points 321 of the bottom surface 32. The abutting end 231 of the mating portion 23 abuts against a front end of the flexible bus 30 for avoiding improper insertion of the flexible bus 30. When the mating portion 23 of the insulative housing 20 is inserted into the mating connector (not shown), the contact points 321 electrically connect with terminals (not shown) of the mating connector.

Figure 9:
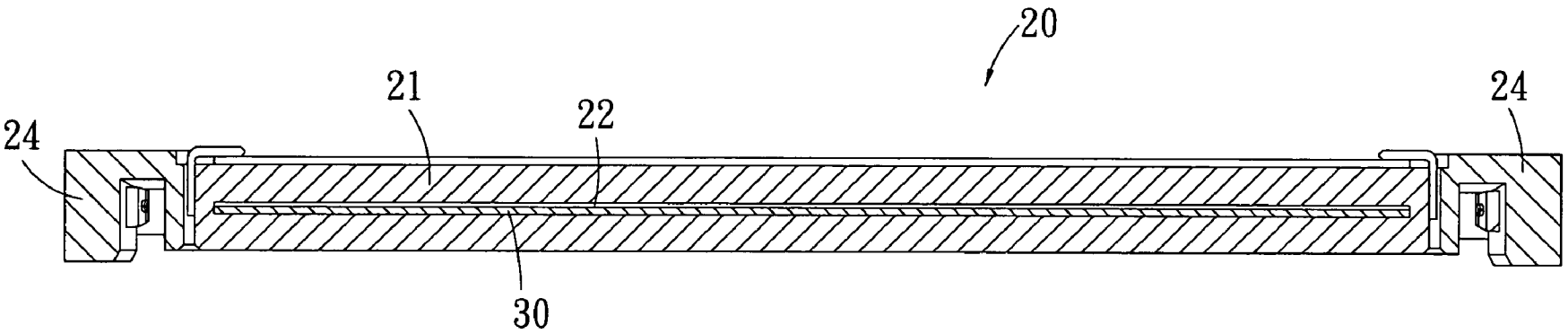
FIG. 9 is a cross-sectional view taken along the line 9-9 of FIG. 8.

Further referring to FIG. 9, width and height of the slot 22 is slightly larger than width and height of the flexible bus 30 such that when the flexible bus 30 is positioned with respect to the mating portion 23, the slot 22 retains the flexible bus 30, thereby guarding the flexible bus 30 against warping or distorting.

Figure 10:
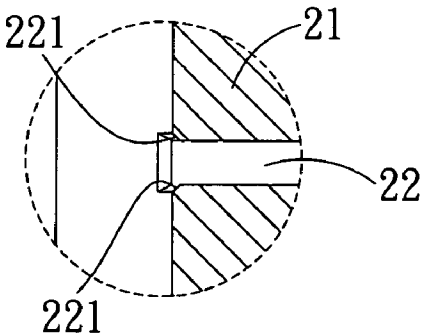
FIG. 10 is an enlarged view of a portion A encircled in FIG. 5.

Referring to FIG. 10, guiding slopes 221 are respectively formed on an upper edge and a lower edge of a front end of the slot 22. While the flexible bus 30 is inserted through the slot 22, the guiding slopes 221 guide the flexible bus 30 for facilitating insertion thereof. Thus, the flexible bus 30 can be extended into the slot 22 smoothly even if width and height of the slot 22 is merely slightly larger than width and height of the flexible bus 30.

In general, the electrical connector of the present invention has advantages as follows.

1. The insulative housing 20 forms an elongated slot 22, and the flexible bus 30 is extended into the slot 22 to be attached to the mating portion 23. This simplified structure makes the assembly easy and rapid, thereby shortening assembly time and decreasing production cost.

2. Width and height of the slot 22 is merely slightly larger than width and height of the flexible bus 30, which prevents the flexible bus 30 from warping or distorting when the flexible bus 30 is positioned with respect to the mating portion 23.

3. The abutting end 231 of the mating portion 23 abuts against a front end of the flexible bus 30, avoiding improper insertion of the flexible bus 30.

4. The guiding slopes 221 are respectively formed on an upper edge and a lower edge of the slot 22. Therefore the flexible bus 30 is able to be assembled easily, which further reduces assembly time.

It is understood that the invention may be embodied in other forms without departing from the spirit thereof. Thus, the present examples and embodiments are to be considered in all respects as illustrative and not restrictive, and the invention is not to be limited to the details given herein.

What is claimed is:

1. An electrical connector comprising:

an insulative housing including a base having a main body portion and a mating portion extending laterally therefrom, a slot being defined in the base to pass laterally through the main body portion and extend to an abutting end formed by the mating portion; and a flexible bus having a top surface and a bottom surface, the bottom surface forming a plurality of contact points on an end thereof an end of the flexible bus extending through the slot of the insulative housing to bear against the abutting end of the mating portion, and the contact points being exposed out of the mating portion.

2. The electrical connector as recited in claim 1, wherein the slot is defined substantially in a middle of the base and through the base, and wherein width and height of the slot is slightly larger than width and height of the flexible bus.

3. The electrical connector as recited in claim 1, wherein the mating portion terminates at the abutting end formed on a front lateral portion thereof for abutting against the end of the flexible bus when the flexible bus is inserted into the slot.

4. The electrical connector as recited in claim 1, wherein guiding slopes are formed on a front end of the slot for guiding the flexible bus to be inserted into the slot.

5. The electrical connector as recited in claim 1, wherein mounting portions are integrally formed on opposite sides of the base and receive fixing sheets therein.

6. The electrical connector as recited in claim 1, wherein a shell is provided to shield the insulative housing.

7. The electrical connector as recited in claim 1, wherein the top surface of flexible bus is coated with glues and is glued to the mating portion.

8. An electrical connector, comprising an insulative housing having a base with mounting portions respectively formed on opposite sides thereof, wherein:

the base includes a main body portion and a mating portion connecting with the main body portion of the base to extend laterally therefrom, a slot for receiving a flexible bus being defined in the base to pass laterally through the main body portion and extend to an abutting end formed by the mating portion, whereby a plurality of contact points of the flexible bus are exposed out of a side of the mating portion when the flexible bus is inserted into the slot to bear against the abutting end of the mating portion.

9. The electrical connector as recited in claim 1, wherein the flexible bus has a top surface and a bottom surface, the contact points being formed on a front end of the bottom surface.

10. The electrical connector as recited in claim 8, wherein guiding slopes are formed on a front end of the slot for guiding the flexible bus to be inserted into the slot.

11. The electrical connector as recited in claim 8, wherein the slot is defined substantially in a middle of the base and through the base, and wherein width and height of the slot is slightly larger than width and height of the flexible bus.

12. The electrical connector as recited in claim 8, wherein the mating portion terminates at the abutting end formed on a front lateral portion thereof for abutting against an end of the flexible bus when the flexible bus is inserted into the slot.

* * * * *